US008893321B2

(12) United States Patent
Delmonico

(10) Patent No.: US 8,893,321 B2
(45) Date of Patent: Nov. 25, 2014

(54) DRAIN SYSTEMS AND RELATED METHODS

(76) Inventor: Michael Delmonico, Arvada, CO (US)

( * ) Notice: Subject to any disclaimer, the term of this patent is extended or adjusted under 35 U.S.C. 154(b) by 922 days.

(21) Appl. No.: 12/100,147

(22) Filed: Apr. 9, 2008

(65) Prior Publication Data

US 2008/0244825 A1 Oct. 9, 2008

Related U.S. Application Data

(60) Provisional application No. 60/910,744, filed on Apr. 9, 2007.

(51) Int. Cl.

| | |
|---|---|
| ***A47K 1/04*** | (2006.01) |
| ***E03C 1/00*** | (2006.01) |
| ***A47K 1/14*** | (2006.01) |
| ***E03C 1/26*** | (2006.01) |
| ***E03C 1/22*** | (2006.01) |
| *E03C 1/23* | (2006.01) |

(52) U.S. Cl.

CPC ... *A47K 1/14* (2013.01); *E03C 1/26* (2013.01); *E03C 2001/2313* (2013.01); *E03C 1/22* (2013.01); *E03C 1/2302* (2013.01)

USPC ..... 4/650

(58) Field of Classification Search

USPC ..... 4/650–653, 679, 680, 688–692, 695, 4/288, 286; 285/139.1, 139.2, 139.3, 285/140.1, 56; 251/31, 25

See application file for complete search history.

(56) References Cited

U.S. PATENT DOCUMENTS

| | | | | |
|---|---|---|---|---|
| 960,901 | A * | 6/1910 | Hall | 210/232 |
| 984,259 | A * | 2/1911 | Beck | 4/287 |
| 1,511,018 | A * | 10/1924 | Binder | 4/287 |
| 1,974,794 | A * | 9/1934 | Blickman | 4/650 |
| 3,727,763 | A * | 4/1973 | Arenskov | 210/163 |
| 4,185,336 | A | 1/1980 | Young | |
| 4,688,277 | A | 8/1987 | Kakinoki et al. | |
| 4,729,406 | A | 3/1988 | Frentzel | |
| 4,762,343 | A * | 8/1988 | Hirohata | 285/140.1 |
| 4,872,482 | A * | 10/1989 | Jarrett | 137/554 |
| 5,080,527 | A | 1/1992 | King, Sr. | |
| 5,103,698 | A * | 4/1992 | Delaney | 81/461 |
| 5,397,099 | A | 3/1995 | Pilolla | |
| 5,535,455 | A * | 7/1996 | Liu | 4/287 |
| 5,611,517 | A | 3/1997 | Saadi et al. | |
| 5,964,241 | A | 10/1999 | King | |
| 6,058,526 | A * | 5/2000 | Parisi et al. | 4/688 |
| 6,138,297 | A * | 10/2000 | Harris et al. | 4/689 |
| 6,195,819 | B1 | 3/2001 | Wang | |
| 6,219,859 | B1 | 4/2001 | Derakhshan | |
| 6,595,556 | B1 * | 7/2003 | Zenko et al. | 285/305 |
| 6,675,407 | B1 | 1/2004 | Ball | |
| 6,725,472 | B2 | 4/2004 | Gray et al. | |
| 7,032,254 | B1 | 4/2006 | Dong et al. | |
| 2004/0238479 | A1 | 12/2004 | Caswel et al. | |

* cited by examiner

*Primary Examiner* — Huyen Le

*Assistant Examiner* — Janie Christiansen

(74) *Attorney, Agent, or Firm* — Lathrop & Gage LLP

(57) ABSTRACT

A drain system includes a basin and a drain, where a first one of the basin and the drain comprises at least two substantially inflexible protrusions and a second one of the basin and the drain forms at least two apertures. The protrusions and apertures form male-female connections that facilitate positioning and anchoring of the drain in the basin. Further, stoppers/strainer and ball valves for limiting or ceasing water flow through a drain are disclosed. The stoppers/strainers and quarter turn valves may be switch-activated and moved into position by electricity, water pressure, air pressure and the like.

14 Claims, 10 Drawing Sheets

DRAIN SYSTEMS AND RELATED METHODS

RELATED APPLICATIONS

This application claims the benefit of priority to U.S. Provisional Patent Application Ser. No. 60/910,744, filed Apr. 9, 2007, which is incorporated by reference herein.

BACKGROUND

Modern wash basins usually contain a drain that provides an escape for waste water. The drain is inserted into a hole in the basin, and a gasket seals around a perimeter of the drain on an underside of the basin. A washer and a basket lock nut secure the gasket to the drain.

Though the parts of the drain are simple, installation of these parts into the wash basin can be a daunting task for an individual. Therefore, installation of a drain is most often a two-person job. One person stands over the basin keeping the drain steady, while the other person lies under the basin using a wrench to tighten or loosen the basket lock nut.

FIG. 1 shows a drain system 100 including a drain 101 and a basin 105. Drain 101 has a rim 102, a basket 103, and a stem 104. Basin 105 has an edge 113 supporting a pair of hot/cold water handles 106 and a faucet 107. A hole 108 is formed within basin 105. Installation of drain 101 into basin 105 is accomplished by inserting drain 101 into hole 108 from a top side of the basin, then placing a gasket 110, a washer 111, and a basket lock nut 112 onto basket 103 from an underside of basin 105. A wrench may be used to tighten basket lock nut 112 onto threads 114 of basket 103. However, application of force to basket lock nut 112 frequently results in rotation of drain 101 rather than independent movement of the basket lock nut.

SUMMARY

In an embodiment, a drain system includes a basin and a drain, where at least one of the basin and the drain forms at least two apertures, and at least one of the basin and the drain comprises at least two substantially inflexible protrusions configured for insertion into the apertures.

In an embodiment, a method for installing a drain system includes: providing a basin and a drain, where at least one of the basin and the drain comprises at least two substantially inflexible protrusions and at least one of the basin and the drain forms at least two apertures; inserting the protrusions into the apertures; and securing the drain to the basin.

In an embodiment, a strainer for preventing solids from entering plumbing includes a circular part having a diameter approximately equal to the internal diameter of a drain and means for maintaining the circular part within the drain. The circular part contains a plurality of orifices.

In an embodiment, a drain includes at least one stopper/strainer disposed within an arm proximal to a drain stem and means for moving the stopper/strainer into and out of the drain stem.

In an embodiment, a drain system includes a quarter turn valve disposed within a drain and an actuator for controlling rotation of the quarter turn valve.

In an embodiment, a drain system includes a quarter turn valve disposed within a drain and a directional vane enclosed within a housing. The directional vane is attached to the quarter turn valve to cause rotation of the quarter turn valve when water flows through the housing.

DETAILED DESCRIPTION

Figure 1:
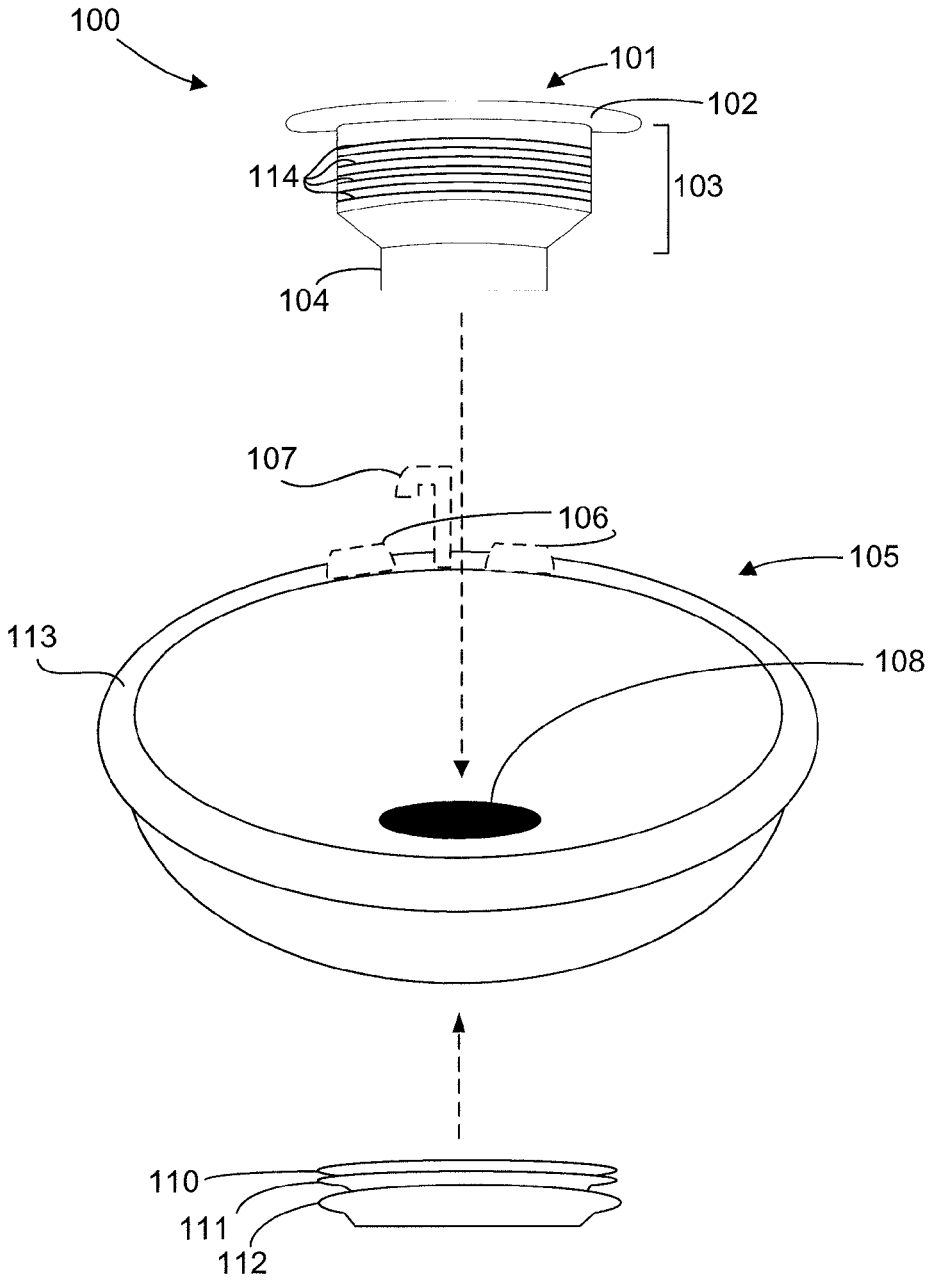
FIG. 1 PRIOR ART
FIG. 1 shows an exemplary prior art drain system.
Figure 2:
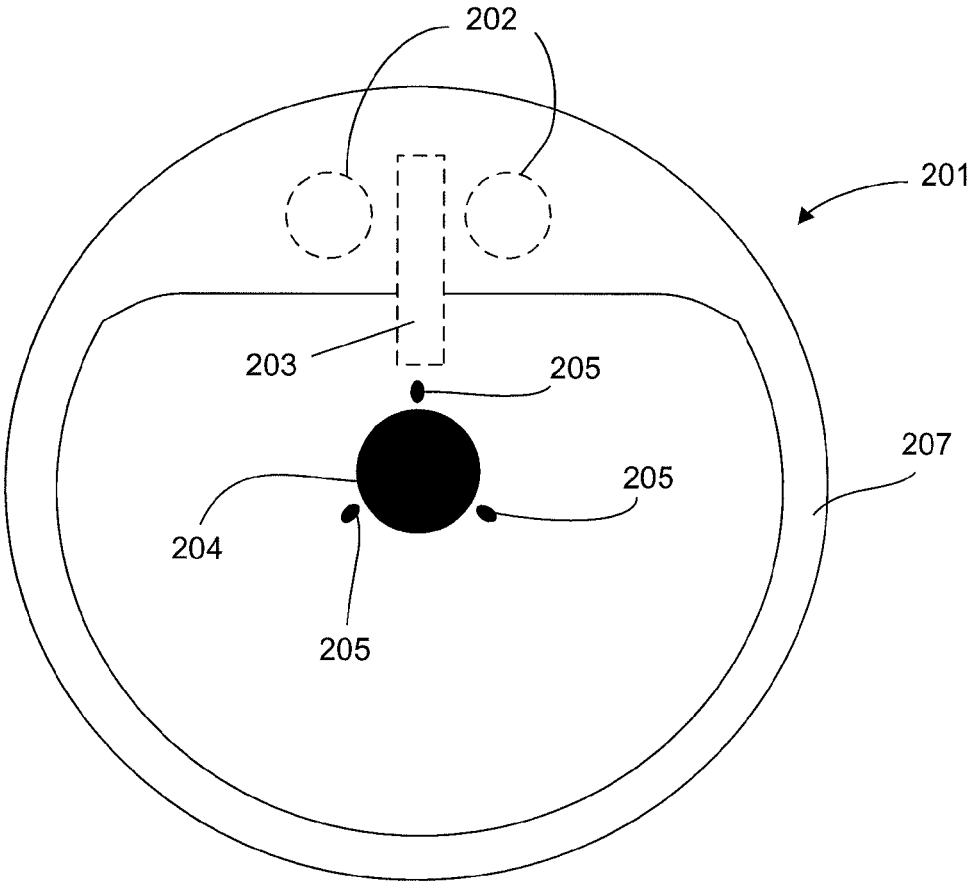
FIG. 2 shows an exemplary basin, according to an embodiment.
Figure 4:
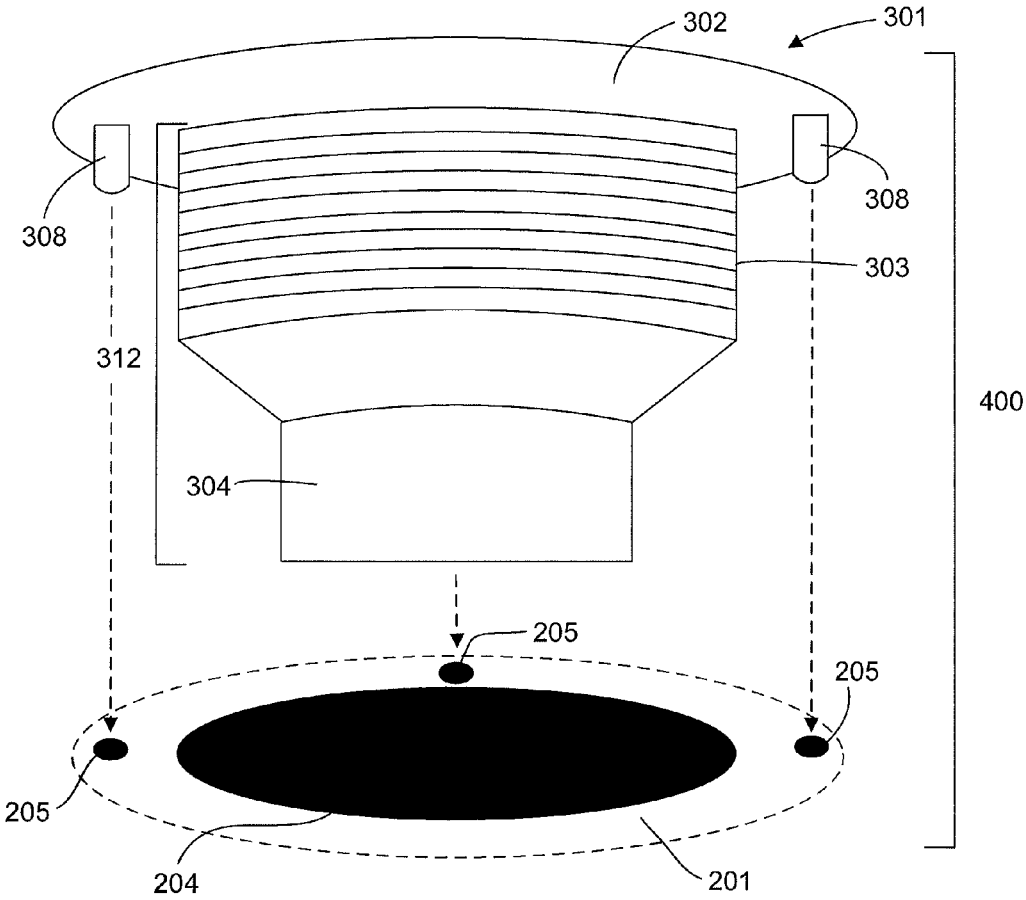
FIG. 4 shows an assembly schematic of a drain system, according to an embodiment.

FIG. 2 shows one configuration of a basin 201 forming part of a drain system (400, FIG. 4). Basin 201 may be similar to basin 105 of FIG. 1. Basin 201 is illustrated with an edge 207 supporting a pair of hot/cold water handles 202, such as handles 106 of FIG. 1, and a faucet 203, such as faucet 107 of FIG. 1. Basin 201 also forms a hole 204, such as hole 108 of FIG. 1. Although shown as a sink, basin 201 may equivalently be a shower, tub or other variation without departing from the scope hereof. In addition, basin 201 forms at least one aperture 205 proximal to hole 204, where the aperture(s) may be provided by a manufacturer or drilled into an existing basin 201 by an end user. It will be appreciated that basin 201 may contain one, two, three, four, five, six or more apertures 205, and that aperture(s) 205 may be formed in one or more shapes, such as oval, circular, square, hexagonal, triangular or irregular.

Figure 3:
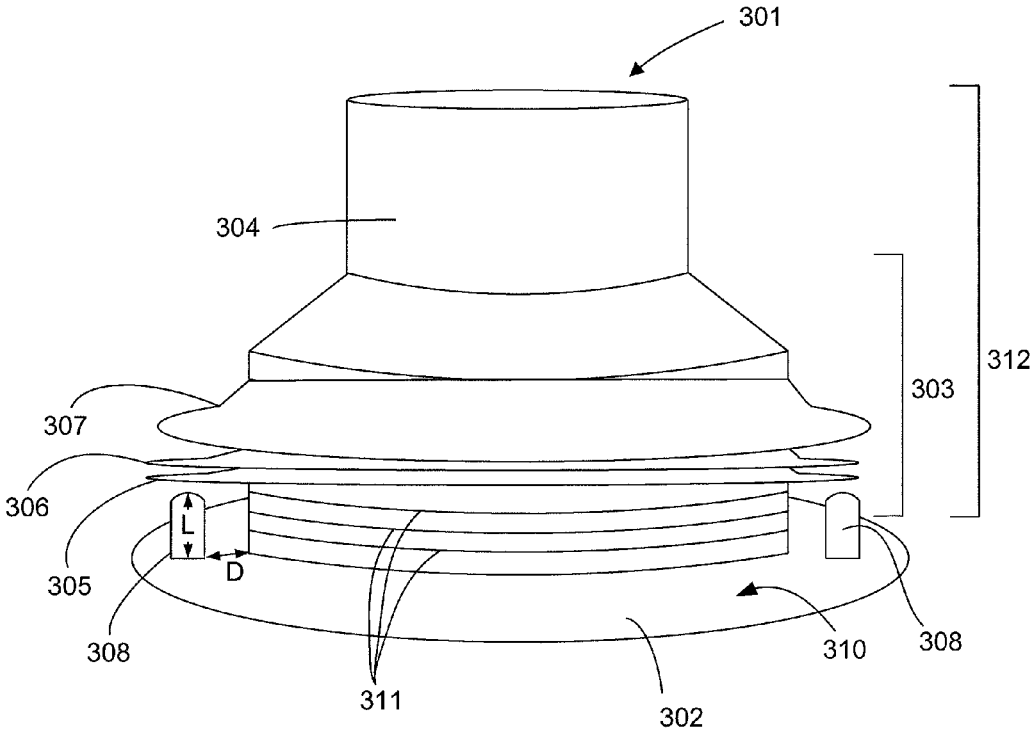
FIG. 3 shows an exemplary drain, according to an embodiment.

FIG. 3 shows an exemplary drain 301 of a drain system (400, FIG. 4). Drain 301 has a rim 302 and a body 312. Body 312 includes a basket 303 and a stem 304. A gasket 305, a washer 306, and a basket lock nut 307 secure drain 301 to basin 201 of FIG. 2. A portion of basket 303 contains threads 311 for mating with basket lock nut 307. Rim 302 has at least one protrusion 308 disposed on an underside 310 of rim 302. Protrusion 308 is substantially inflexible and has a maximum length L, for example, of approximately 5 mm to 3 cm, and a width of about 5 mm to 3 cm. Protrusion 308 is typically disposed a distance D of, for example, about 0 mm to 1.5 cm from body 312 of drain 301. When protrusion 308 is disposed a distance of 0 mm from body 312, e.g., when protrusion 308 forms a part of body 312, it will essentially form an extension of basket 303 that serves to break the rotational symmetry of the circular basket. Protrusion(s) 308 may be used to align drain 301 to basin 201. Although two protrusions 308 are shown in FIG. 3, it will be appreciated that more or fewer protrusions, of various styles, may be utilized. In some embodiments, protrusion(s) 308 may be threaded for receiving a locking nut.

As used herein, the term "substantially inflexible protrusion" refers to a protrusion that is not readily bent and which is generally incapable of changing shape or position.

FIG. 4 shows an assembly schematic of drain system 400. System 400 includes drain 301 and basin 201. As shown, body 312 of drain 301 is aligned with hole 204, and protrusions 308 are aligned with apertures 205. Protrusions 308 may be used as male connectors to mate with apertures 205, which form female receptacles. It will be appreciated that apertures 205 may be formed as recesses configured as cup-like receptacles or as open-ended conduits. If aperture 205 is an open-ended conduit, a gasket may be used at the aperture to prevent leakage. Once protrusions 308 enter apertures 205, the position of drain 301 becomes fixed relative to basin 201. Rotational force may then be applied to tighten or loosen basket lock nut 307, FIG. 3, without inducing spinning of drain 301. Thus, drain systems, as disclosed herein, may be assembled by a single person.

Figure 5:
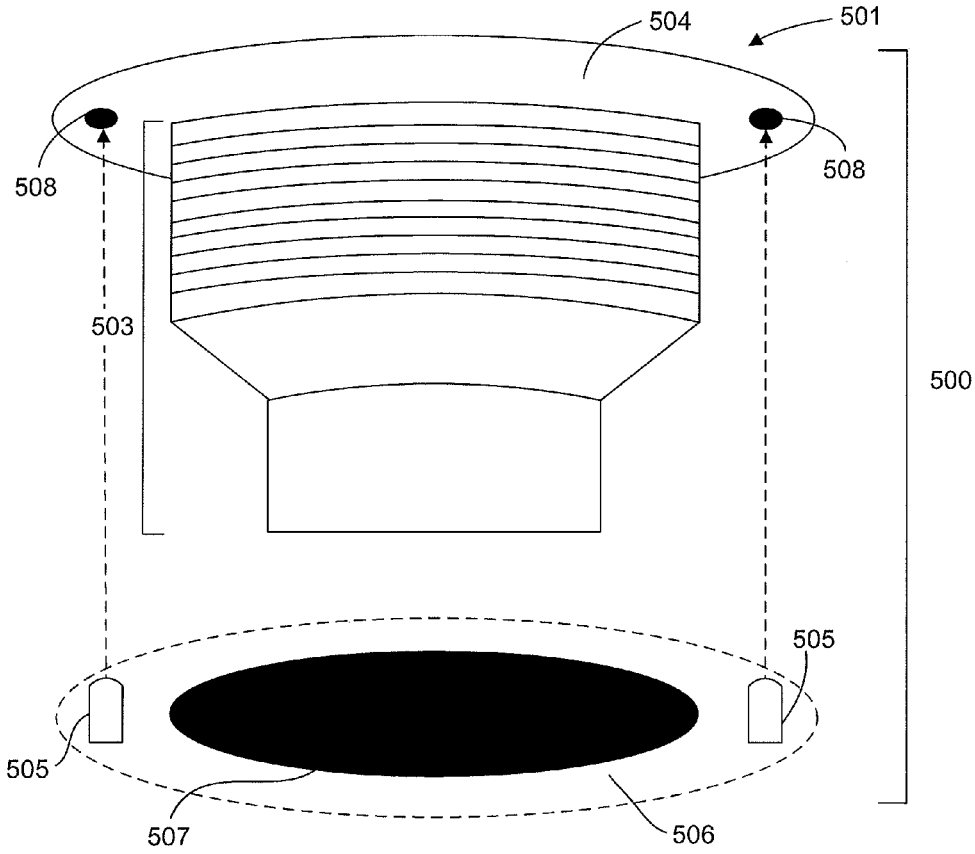
FIG. 5 shows another assembly schematic of a drain system, according to an embodiment.

FIG. 5 shows an assembly schematic of a drain system 500. A drain 501 has a rim 504 and a body 503. A basin 506 may include at least one protrusion 505 disposed proximal a hole 507. Drain 501 may form at least one aperture 508 within rim 504. It will be appreciated that aperture 508 may be formed as a recess configured as a cup-like receptacle or as an open-ended conduit. If aperture 508 is an open-ended conduit, a gasket may be used at the aperture to prevent leakage. Assembly of drain system 500 may be accomplished by aligning body 503 with hole 507, and aperture(s) 508 with protrusion(s) 505. Mating of drain 501 with basin 506 in this orientation prevents drain 501 from rotating when an external rotational force is applied to a basket lock nut (e.g., basket lock nut 307, FIG. 3).

Components of drain systems 400 and 500 may be fabricated, for example, from one or more materials selected from stainless steel, metals, metal alloys, plastics, enamels, porcelain, ceramics, glass, soapstone, concrete, terrazzo, and combinations thereof.

Figure 6:
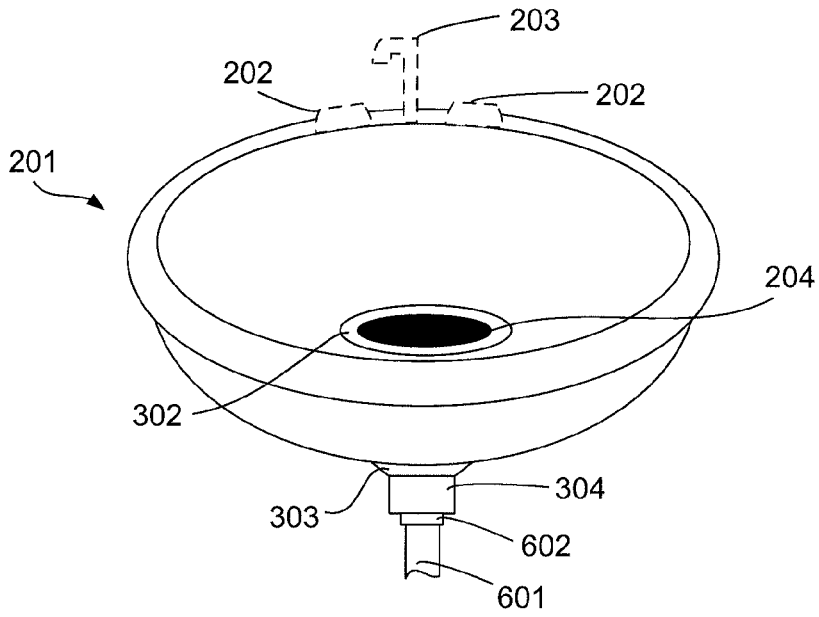
FIG. 6 shows a perspective view of an assembled drain system, according to an embodiment.

Following installation of drain 301, 501, plumbing (601, FIG. 6) may be connected to stem 304, 504 using a stem lock nut 602. In one example, drain 301, 501 joins directly with a garbage disposal, which then connects to plumbing 601.

Figure 7:
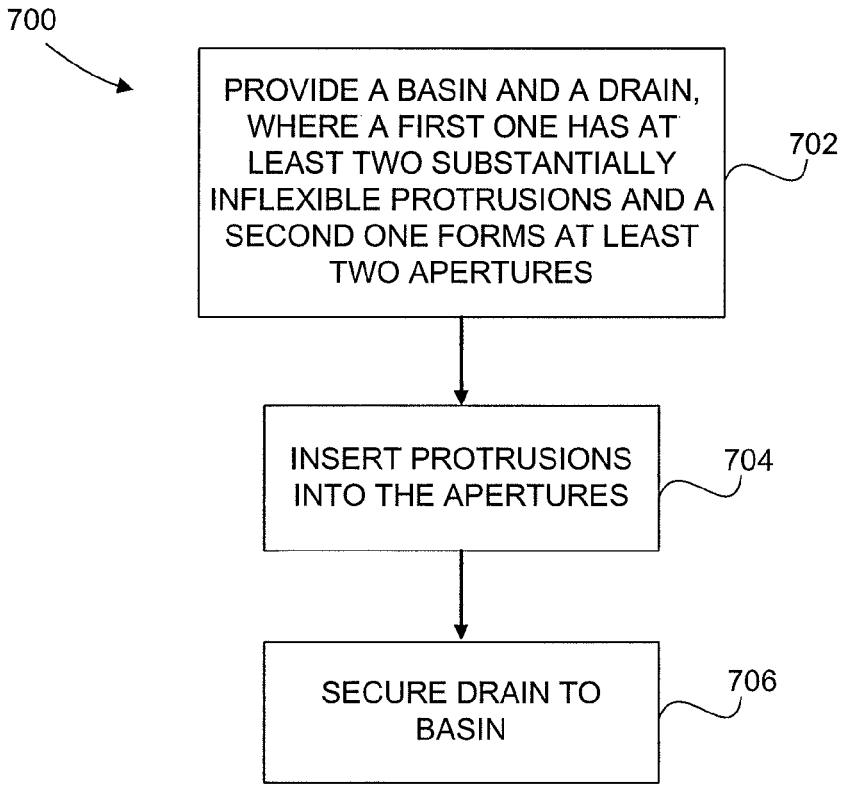
FIG. 7 shows an exemplary method for installing and removing a drain system, according to an embodiment.

FIG. 7 shows an exemplary method 700 for installing drain system 400, 500. Method 700 starts with step 702. In step 702, a basin 201, 506 and a drain 301, 501 are provided, where a first one of the basin and the drain comprises at least two substantially inflexible protrusions 308, 505 and a second one of the basin and the drain forms at least two apertures 205, 508. Method 700 continues with step 704. In step 704, protrusion(s) 308, 505 are inserted into apertures 205, 508, which prevent drain 301, 501 from rotating when force is applied to basket lock nut 307. Tightening of basket lock nut 307 secures drain 301, 501 to basin 201, 506 in step 706. The combination of steps 702-706 results in an assembled drain system 400, 500. When steps 702-706 are performed in reverse order, drain 301, 501 may be removed from basin 201, 506.

Figure 8:
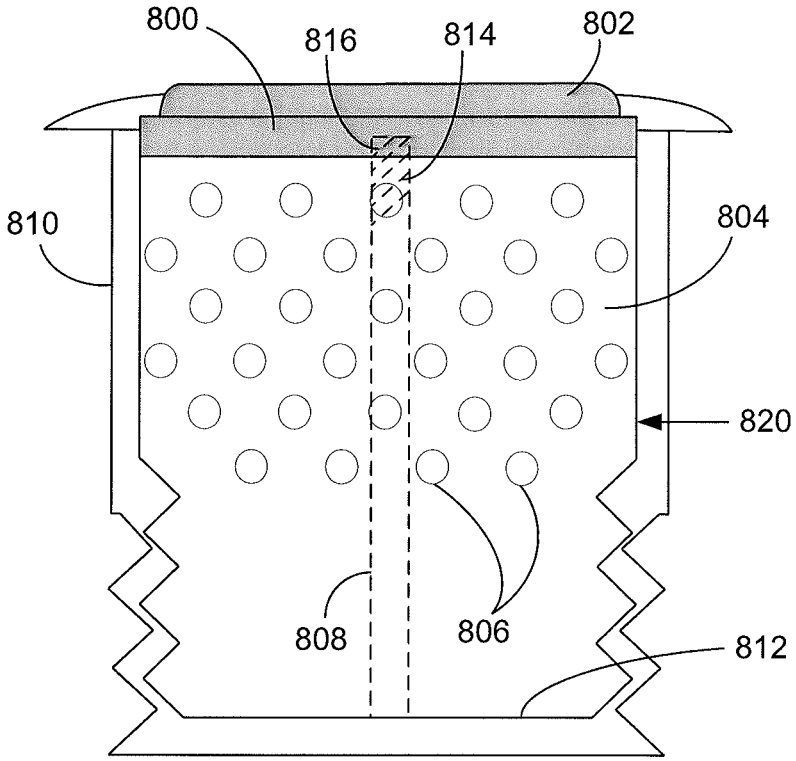
FIG. 8 shows an exemplary cross-sectional side view of a stopper and a strainer disposed within a drain, according to an embodiment.

FIG. 8 shows an exemplary cross-sectional side view of a stopper 800 and a strainer 804 disposed within a drain 810. Stopper 800 is configured to seal drain 810 in a water-tight manner when stopper 800 is closed, e.g., using a handle 802. Strainer 804 includes a circular part 812 forming a base of a cylinder having a wall 820. A threaded portion at the distal end of strainer 804 is configured for mating with a threaded portion of drain 810. Strainer 804 includes orifices 806 that provide passage for water through strainer 804 into drain 810 when stopper 800 is open. Orifices 806, which may be disposed within circular part 812 and/or wall 820, trap solid particles such as hair, food, etc. within strainer 804.

In one embodiment, strainer 804 may contain a central post 808 disposed at a center point of circular part 812 and perpendicular thereto. Post 808 may contain a threaded top portion 814 for mating with a complementary threaded portion 816 of stopper 800. In one example of operation, a user may rotate handle 802 counterclockwise to open stopper 800, thus allowing water to flow from a basin through orifices 806 into drain 810. On the other hand, stopper 800 may be rotated clockwise to a closed position, thereby sealing stopper 800 and stopping the flow of water through drain 810. Those skilled in the art will further appreciate that strainer 804 may be used to collect solid particles without the use of stopper 800.

Figure 9:
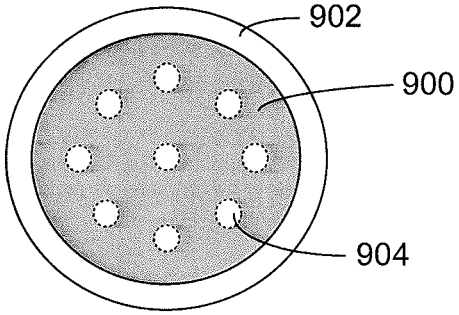
FIG. 9 shows an exemplary top plan view of a switch-activated stopper/strainer disposed within a drain, according to an embodiment.

FIG. 9 shows an exemplary top plan view of a switch-activated stopper/strainer 900 disposed inside a drain 902. Stopper/strainer 900 is generally a circular part that optionally contains orifices 904, e.g., when a strainer configuration is desired. Orifices 904 may, in one example, be formed by a wire mesh. A drain system may be configured with a switch (1018, FIG. 10) or valve (1108, FIG. 11) that allows water pressure, air pressure, a solenoid, a motor or the like to move stopper/strainer 900 into and out of drain 902, thereby controlling the flow of water from a basin to plumbing.

Figure 10:
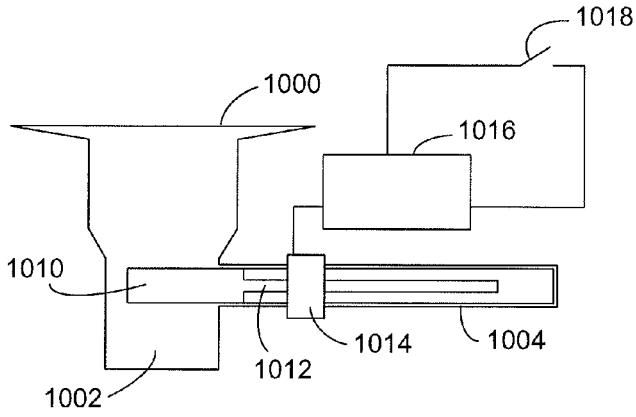
FIG. 10 shows an exemplary cross-sectional side view of a drain system including an electrically-activated stopper/strainer, according to an embodiment.

FIG. 10 shows an exemplary cross-sectional side view of a drain system including an electrically-activated stopper/strainer 1010. FIG. 10 shows drain 1000 having a stem 1002, which is configured to receive an arm 1004. Stopper/strainer 1010 may be disposed, at least partially, inside arm 1004 from which stopper/strainer 1010 extends and retracts. In the embodiment shown, stopper/strainer 1010 is connected to a piston 1012. Movement of piston 1012 is controlled by a controller 1014, such as a motor or solenoid valve. Controller 1014 connects to a switch 1018 and a power source 1016. Switch 1018 activates controller 1014 to extend or retract piston 1012 and stopper/strainer 1010 into and out of stem 1002.

In an example of operation, stopper/strainer 1010 may be disposed within arm 1004 until a user closes switch 1018. With switch 1018 closed, power is supplied to controller 1014, which moves piston 1012 and stopper/strainer 1010 into stem 1002. When switch 1018 is opened, supply of power to controller 1014 may cease and piston 1012 and stopper/strainer 1010 may retract out of stem 1002.

In another example, stopper/strainer 1010 may be disposed within stem 1002 until a user closes switch 1018. When switch 1018 is closed, power is supplied to controller 1014, which moves piston 1012 and stopper/strainer 1010 into arm 1004. When switch 1018 is opened, supply of power to controller 1014 may cease and piston 1012 and stopper/strainer 101 may extend into stem 1002.

Figure 11:
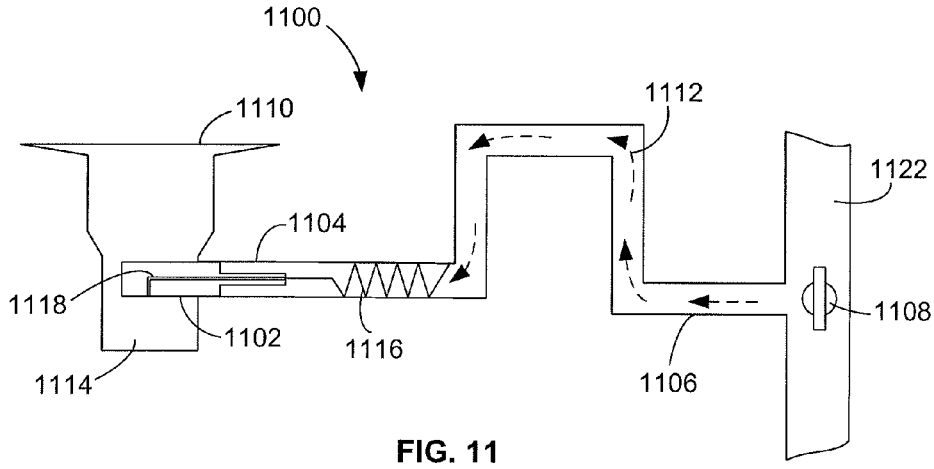
FIG. 11 shows an exemplary cross-sectional side view of a drain system including a stopper/strainer operated by water or air pressure, according to an embodiment.

FIG. 11 shows an exemplary cross-sectional side view of a drain system 1100. System 1100 includes a stopper/strainer 1102 operated by air or water pressure 1112. A drain 1110 has a stem 1114, which is configured to receive an arm 1104. In the embodiment shown, arm 1104 forms part of a water line 1106 that connects to a pipe 1122 that provides water (e.g., to a faucet 102, 203). A valve 1108, which may be a T-valve, controls the flow of water through water line 1106. Water line 1106 preferably has a relatively small diameter (e.g., between about one inch and one-quarter inch) in order to provide high water pressure 1112. A spring 1116 is disposed within arm 1104 and is fixedly connected to stopper/strainer 1102. Spring 1116 biases stopper/strainer 1102 in an open (retracted) position. A user may engage or disengage stopper/strainer 1102 by turning valve 1108 to control the flow of water from pipe 1122 to water line 1106. When valve 1108 is open, water pressure 1112 builds within water line 1106 and eventually overcomes the biasing pressure of spring 1116, thus urging stopper/strainer 1102 into a closed (extended) position.

When valve 1108 is closed, water pressure is released via pressure outlet 1118. Pressure outlet 1118 is a channel within stopper/strainer 1102 from which water can escape into plumbing. When enough water pressure 1112 is released from pressure outlet 1118, spring 1116 retracts stopper/strainer 1102 into the original open position. Those skilled in the art will recognize that air pressure may be provided in place of water pressure to achieve the desired movement of stopper/strainer 1102.

Alternately, the drain systems of FIGS. 10 and 11 may contain more than one stopper/strainer. For example, a system may contain one stopper and one strainer or a course strainer and a fine strainer (and optionally a stopper). Configurations incorporating multiple electrical circuits and controllers and/or multiple water lines and valves may be used to accommodate a plurality of stoppers/strainers.

Figure 12:
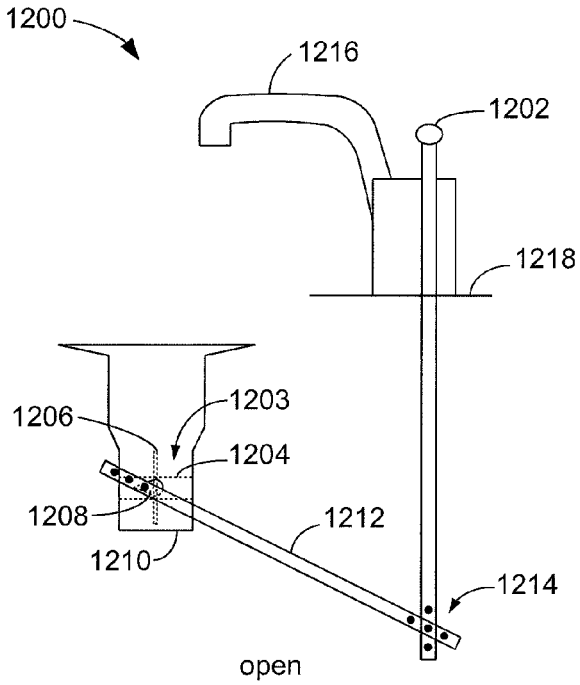
FIGS. 12 and 13 show exemplary side plan views of a drain system including a butterfly valve operated by a plunger, according to an embodiment.
Figure 13:
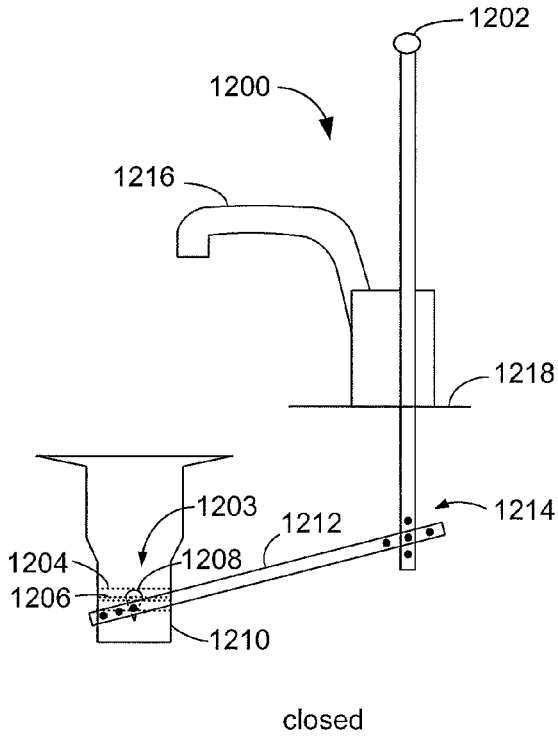

FIGS. 12 and 13 show exemplary plan side views of a drain system 1200 including a butterfly valve, ball valve or other quarter turn valve operated by a plunger 1202. As shown, the quarter turn valve is a butterfly valve 1203 including a cylindrical body 1204 disposed flush to a wall of a drain stem 1210; a disk 1206 rotatable about a rod (not shown) disposed through a diameter of the disk; and an actuator 1208 configured to control rotation of disk 1206 (via the rod). Actuator 1208 is attached to a rigid, pivotable connector 1212 that joins with a proximal end 1214 of plunger 1202. Plunger 1202 is disposed, for example, with a faucet 1216 above a basin 1218.

In an example of operation, butterfly valve 1203 is open, i.e., disk 1206 is vertically positioned (as shown in FIG. 12) so that water can flow from basin 1218 into drain stem 1210, when plunger 1202 is pressed downward. When plunger 1202 is pulled upward, connector 1212 urges actuator 1208 to rotate a quarter turn (90 degrees), which rotates disk 1206 to a horizontal position (as shown in FIG. 13), and water is prevented from entering drain stem 1210. Butterfly valve 1203 may be re-opened by pressing plunger 1202 downward to reverse the rotation of actuator 1208.

Figure 14:
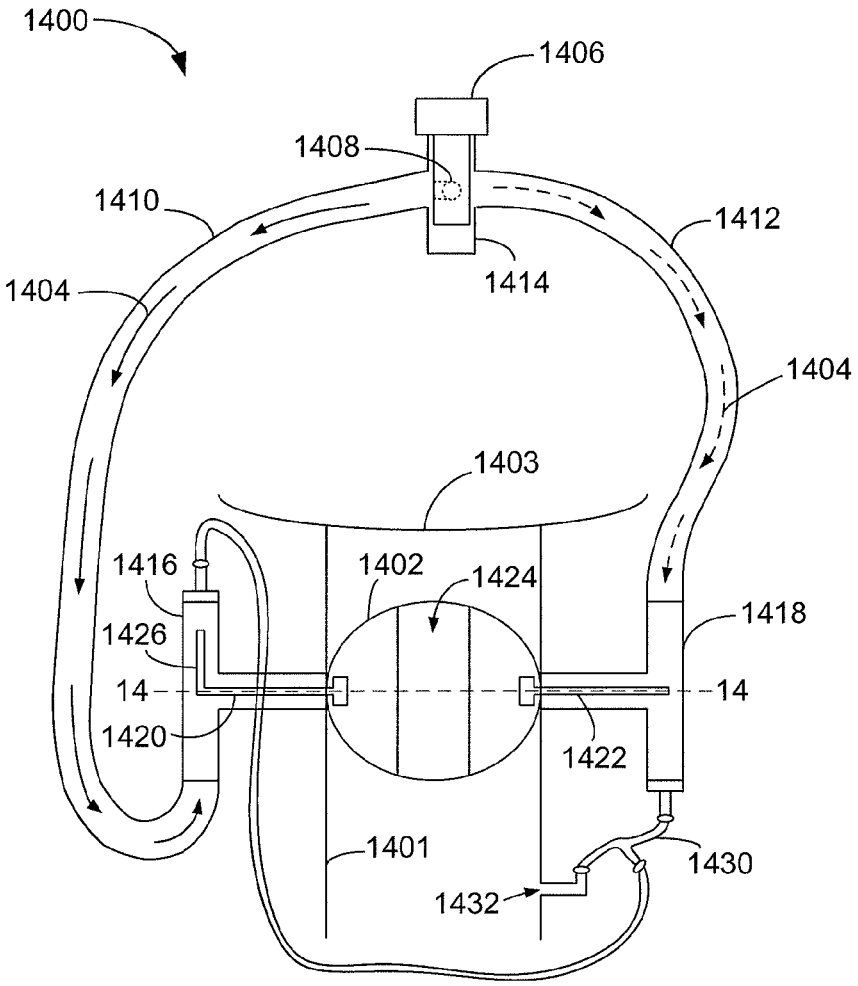
FIGS. 14-16 show an exemplary cross-sectional side view of a drain system including a ball valve operated by water pressure, according to an embodiment.

FIG. 14 shows an exemplary cross-sectional side view of a drain system 1400 including a ball valve, butterfly valve or other quarter turn valve 1402 disposed within a drain 1401 attached to a basin 1403. Operation of ball valve 1402 is controlled by water pressure 1404, where water may, for example, be diverted from flow within a main plumbing line (not shown). Valve 1406 may be opened and closed by pulling valve 1406 upward or pushing valve 1406 downward into base 1414, respectively. When valve 1406 is closed, water bypasses and does not enter drain system 1400. When valve 1406 is opened, water from the main plumbing line passes through an L-shaped duct 1408 within valve 1406 to tubing 1410 or 1412, depending upon the rotation of valve 1406.

Figure 15:
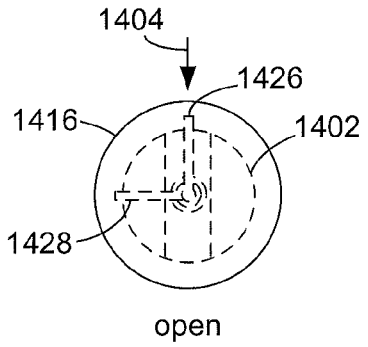
Figure 16:
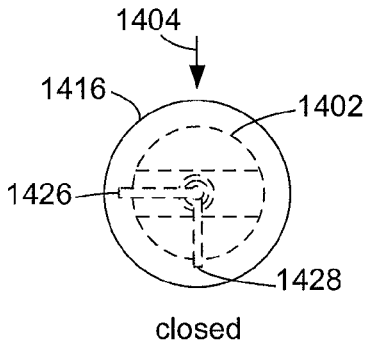

Water from tubing 1410 or 1412 then enters a housing 1416 or 1418. Housings 1416 and 1418 each contain a directional vane 1420 or 1422, respectively. Directional vanes 1420 and 1422 are attached to ball valve 1402 at opposite points of an axis (shown as line 14-14) that bisects a midpoint of conduit 1424. Directional vanes 1420 and 1422 each have an arm 1426, 1428 that causes rotation of ball valve 1402 in response to the direction of water flow within housing 1416 or 1418. Arms 1426 and 1428 are offset 90 degrees relative to one another in order to provide proper opening and closing of ball valve 1402. For example, when water enters housing 1416, it forces arm 1426 upward and conduit 1424 of ball valve 1402 becomes aligned with a longitudinal axis of drain 1401 so that water may exit basin 1403 via conduit 1424 (see FIG. 15 showing an open configuration, as viewed along line 14-14). On the other hand, when water enters housing 1418, it forces arm 1428 downward and conduit 1424 of ball valve 1402 becomes aligned perpendicular to the longitudinal axis of drain 1401 so that basin 1403 becomes plugged (see FIG. 16 showing a closed configuration, as viewed along line 14-14). Housings 1416 and 1418 are attached to a pressure relief valve 1430 which provides for passage of water into drain 1401 via inlet 1432.

Those skilled in the art will appreciate that changes may be made to drain system 1400. For example, ball valve 1402 may be biased in an open position, e.g., by one or more springs, and only one directional vane 1420, 1422 may be present. In another example, ball valve 1402 may be biased in an open position, e.g., by one or more springs, until a valve (similar to valve 1406) containing a T-duct is opened. Water from tubes 1410 and 1412 may then act in concert on directional vanes 1420 and 1422 to promote closing of ball valve 1402.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present methods and systems, which, as a matter of language, might be said to fall there between.

What is claimed is:

1. A drain system comprising:

a basin having a hole, and a drain having a rim for mating with a portion of the basin proximate the hole of the basin, at least one of the basin portion and the drain rim comprising at least two protrusions, one end of each of the protrusions being fixed directly to a surface of one of the basin portion and drain rim facing the other of the basin portion and drain rim, the protrusions being substantially inflexible with respect to the respective facing surface to which the protrusions are directly fixed;

at least one of the basin portion and the drain rim forming at least two recesses configured for receiving the protrusions; and a basket lock nut for rotationally securing the drain with the basin, the recesses and protrusions preventing rotation of the drain when rotational force is applied to the basket lock nut about a threaded portion of the drain to secure the drain with the basin.

2. The system of claim 1, wherein the protrusions are disposed on and directly fixed to the surface of rim of the drain directly facing the basin portion, and the recesses are disposed along the basin portion.

3. The system of claim 2, wherein the substantially inflexible protrusions are disposed along the surface of the drain rim at a distance of about 0 mm to 1.5 cm from a body of the drain.

4. The system of claim 1, wherein the recesses are disposed along the rim of the drain and the protrusions are disposed along and directly fixed to the surface of the basin portion directly facing the drain rim.

5. The system of claim 1, wherein the drain system components comprise one or more materials selected from stainless steel, metals, metal alloys, plastics, enamels, porcelain, ceramics, glass, soapstone, concrete, terrazzo, and combinations thereof.

6. The system of claim 1, wherein the protrusions have a length, extending substantially perpendicularly from the surface, of about 5 mm to 3 cm.

7. The system of claim 1, wherein the protrusions have a width, extending substantially parallel along the surface, of about 5 mm to 3 cm.

8. The system of claim 1, wherein a length of the protrusions extending away from the surface is substantially the same as a width of the protrusions extending along the surface.

9. A method for installing a drain system including a basin and a drain, comprising the steps of:

fixing at least two protrusions to at least one of the basin and the drain, the protrusions being substantially inflexible with respect to the at least one of the basin and the drain by the step of fixing;

aligning the at least two protrusions, after the step of fixing, with at least two corresponding recesses disposed on the other of the at least one of the basin and the drain;

mating, after the step of aligning, the at least two protrusions with the at least two corresponding recesses;

securing the drain to the basin after the step of mating; and wherein the step of securing comprises applying a rotational force to a basket lock nut around a threaded portion of the drain, and wherein the mating of the at least two protrusions with the at least two corresponding recesses prevents rotation of the drain with respect to the basin when the rotational force is applied to the basket lock nut.

10. The method of claim 9, wherein, in the step of fixing, the protrusions are directly disposed on a rim of the drain facing the basin.

11. The method of claim 9, wherein the recesses are disposed within a rim of the drain.

12. The method of claim 9, wherein, in the step of fixing, the protrusions are disposed proximate a hole in the basin for receiving the drain.

13. The method of claim 9, wherein the recesses are disposed proximate a hole in the basin.

14. A drain system, comprising:

a basin having a bottom portion including an upper surface, an under surface opposite the upper surface of the bottom portion, and a hole for receiving a drain;

a drain having a rim for mating with the upper surface of the bottom portion of the basin proximate the hole;

at least two protrusions, one end of each of the at least two protrusions being fixed directly to one of the upper surface of the basin and a mating surface of the drain rim directly facing the basin upper surface, the protrusions being substantially inflexible with respect to the basin upper surface or drain rim mating surface to which the protrusions are directly fixed;

at least two recesses configured for receiving the at least two protrusions, and disposed along the other of the upper surface of the basin and mating surface of the drain rim; and a lock nut for rotationally securing the drain with the basin, the lock nut securing to the under surface of the basin bottom portion, and the recesses and protrusions preventing rotation of the drain with respect to the basin when rotational force is applied to the lock nut to secure the drain with the basin.

* * * * *